United States Patent [19]

Berard et al.

[11] 4,320,380

[45] Mar. 16, 1982

[54] ELECTRONICALLY CONTROLLED SAFETY MECHANISM FOR HIGHWAY EXIT RAMP

[75] Inventors: Louis N. Berard, St. Louis; Leonard A. Stein, St. Louis County, both of Mo.

[73] Assignee: Devices Development Corporation, St. Louis, Mo.

[21] Appl. No.: 171,148

[22] Filed: Jul. 22, 1980

[51] Int. Cl.[3] ..... E01F 13/00; G08G 1/00

[52] U.S. Cl. ..... 340/39; 340/31 R; 49/49

[58] Field of Search ..... 49/31, 49, 141, 264; 246/125, 125.5; 340/31 R, 45, 39, 38 R, 22; 404/1, 6, 9

[56] References Cited

U.S. PATENT DOCUMENTS

| | | | |
|---|---|---|---|
| 3,325,782 | 6/1967 | Der | 340/31 R |
| 3,587,012 | 6/1971 | Piekarski | 340/39 X |
| 3,626,638 | 12/1971 | Lafferty | 49/49 |
| 3,876,973 | 4/1975 | Griebel | 49/49 |
| 4,133,140 | 1/1979 | Berard et al. | 49/49 |

*Primary Examiner*—Thomas A. Robinson
*Attorney, Agent, or Firm*—Paul M. Denk

[57] ABSTRACT

An electrically controlled safety mechanism for a highway exit ramp for detecting vehicle movement in the wrong direction, including a series of electrically controlled detection devices provided within the roadway, a warning member and support housing for the mechanism located adjacent to the roadway, and some distance beyond the road bed located detection devices, the warning member of the housing being pivotally mounted with respect to its base and capable of disposition in a nonoperative vertical position, but pivotal into a horizontal position when the detection devices sense the presence of a vehicle traveling in the wrong direction, a motor, brake, and speed reducer associated with the housing, for operation of the warning member, and for initiating its pivotal movements, the circuitry of this device including time operative electrical relay and electrical controller relays connected together for providing timed operations to the said motor and related mechanisms, so that the warning member will be conveniently pivoted into its operative and vehicle impeding position when a wrong way vehicle has been detected, and remain in such position for a segment of time, and then returned to its upright position after the hazardous condition has theoretically been alleviated.

23 Claims, 12 Drawing Figures

ELECTRONICALLY CONTROLLED SAFETY MECHANISM FOR HIGHWAY EXIT RAMP

CROSS-REFERENCE TO RELATED PATENT

The subject matter of this application is related to the subject matter of our prior U.S. Pat. No. 4,133,140, which issued on Jan. 9, 1979.

BACKGROUND OF THE INVENTION

This invention relates generally to a warning means, and more specifically pertains to an electrically controlled safety mechanism for a highway exit ramp or other roadway, and useful for warning the wrong way driver that he is proceeding in the incorrect direction, and thereby obviates the occurrence of a head-on collision.

Numerous types of vehicle barriers have been provided in the prior art, and usually these barriers are of the type that are customarily employed in parking lots, for allowing egress or exit from the same, and in addition, some attention has been given to the application of a barrier upon the exit ramp from a highway, where the frequency of head-on collision has accelerated in recent years. An example of this type of prior art safety mechanism is shown in our previous United States patent, listed above, and in addition, various other types of methods and apparatuses for deterring wrong way drivers are shown in other earlier United States patents such as the U.S. Pat. No. 3,876,973, to Griebel. As can be seen therein, a traffic deflection means is positioned along the thoroughfare for the purpose of alerting the driver to his wrong way direction of travel, through the use of a detection means in the nature of a controller, usually provided alongside the roadway, at some predetermined distance ahead of the barrier member. Other forms of traffic controller systems are shown in the U.S. Pat. No. 3,325,782, to Der, wherein the warning means is triggered through the use of switches that are provided within the roadway surface. The U.S. Pat. No. 3,823,510, to Panaccione, discloses an automatically positionable gate assembly which pivots between raised and lowered positions, for the purpose of blocking the flow of traffic, when in the latter position, but principally for use as a traffic control. Various other types of railway crossing gates or controls are shown in the prior art, as in the U.S. Pat. No. 1,531,987, to Smith, and the previous U.S. Pat. No. 1,812,559, to Sampson.

An automatic release type of traffic control arm is shown in the U.S. Pat. No. 2,687,588, to Nutter, as is a coin operated flush mounted vehicle barrier, of the type used adjacent parking lots, and as disclosed in the U.S. Pat. No. 2,741,859, to Castle, et al. Other freeway safety devices are shown in the U.S. Pat. No. 3,226,103, to Schmidt, while the traffic control device utilizing mechanical means actuated within the roadway bed is shown in the U.S. Pat. No. 3,389,677, to Dunne. And, a wrong-way traffic safety barrier is disclosed in the U.S. Pat. No. 3,626,638, to Lafferty. Finally, an automatic railroad crossing gate is shown in the prior U.S. Pat. No. 1,914,359, to Butts.

While all of the various prior art traffic detecting and safety means are more than likely acceptable and useful for their intended purposes, the current invention, on the other hand, incorporates the mechanics of the type of barriers as shown in the prior art, but which has been substantially reduced in mechanical components, and which revised components are effectively operated from electrical control means that can sense the presence and direction of a vehicle travelling upon the roadway.

It is, therefore, the principal object of this invention to provide a combined mechanically operative and electrically controlled highway safety mechanism that can immediately and instantaneously detect the presence of a wrong-way driver, and instantaneously locate a barrier across the roadway, well ahead of the driver's movement, to alert him of his existing problem.

Another object of this invention is to provide a safety mechanism incorporating a warning or barrier member that remains triggered alongside the roadway in preparation for instantaneous usage, but which mechanism being electrically controlled can also sense the driver who is travelling in the correct direction, and therefore remain inactive from usage.

Still another object of this invention is to provide an electrically controlled safety mechanism which incorporates various forms of switches and triggering mechanisms that can inactivate the operations of the warning device in the event that it is encountered by a vehicle during its emplacement, or while the safety mechanism is being serviced by the mechanic.

Still another object of this invention is to provide a warning device that can stop cars moving in the proper direction from colliding into that vehicle inadvertently traveling in the wrong direction.

Yet another object of this invention is to provide a safety mechanism for a highway exit ramp that can operate more than one semaphore or warning member along the length of the said roadway.

Another object of this invention is to provide a safety mechanism for the highway that in addition to operating a structured warning member, can also generate various sounds, ring bells, or flash lights as additional means for alerting all drivers upon said ramp that something is amiss.

Yet another object of this invention is to provide various types of timing means incorporated within the electrical controls for a safety mechanism, and which can inactivate those electrical controls that initiate the pivoting of a warning member so that a vehicle traveling in the right direction can be detected, and the electrical controls inactivated so as to prevent the pivot of the warning member into its operative disposition, but at the same time, in the event that a vehicle is detected traveling in the wrong direction, such controls deactivate and allow other primary electrical controls to initiate energization of the drive means that pivots the semaphore or warning member horizontally across the roadway and into a vehicle obstructing position.

Still another object of this invention is to provide cam means for adjusting the degree and angular limits to the pivot of the semaphore or warning member used in conjunction with a safety mechanism alongside the highway exit ramp.

A further object of this invention is to provide a safety mechanism that is of reduced mechanical components, contains electrical controls that can be mounted substantially upon a single circuit board, therefore reducing the entire mechanical and electrical components provided within the mechanism, and hence reducing the size of its package.

Yet another object of this invention is to provide a safety mechanism that is of significantly reduced components and which expedites and facilitates its assembly and manufacture.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the integration of sensitive electronic controls into the controller portion of a safety mechanism utilized in conjunction with a highway exit ramp, with the principal purpose being, as previously explained, to warn all drivers that a vehicle is approaching in the wrong direction upon said ramp. More specifically, in its mechanical structure, this invention utilizes a barrier means, semaphore, or other type of warning member that is mounted upon a housing and its base at a position just laterally of the roadway, with the warning member having sufficient length to provide for its horizontal disposition, when operative, entirely across the roadway, and act as a direct barrier against any further flow of traffic, and particularly that which may be traveling in the wrong direction upon the highway exit ramp, and which without such safety mechanism such vehicle may eventually obtain access onto the highway and commence traveling in the wrong direction. Numerous statistics readily indicate the number of deaths and serious injuries that occur annually as a result of such a predicament.

The housing of this mechanism incorporates an electrical motor, preferably of the reversible motor type, so that the warning member can be both initiated into a cautioning position across the roadway, as when made operative, but at the same time, be retracted into its upright and nonoperative position after the emergency conditions have passed. Coupled with the reversible motor is a brake means, as a magnetic brake, and connected with the same is a speed reducer, preferably for providing some drop in the speed of rotation of the motor, and to that level which provides for the prompt pivotal movement to the warning member of this mechanism, but not at such great speed as to cause its own destruction, internal damage to this mechanism, or to even catch a vehicle at that instance when it may be passing directly under the pivoting warning member. In addition, the speed reducer of this mechanism may achieve furher reduction in speed as obtained through the use of a right hand drive speed reducer, which usually incorporates a worm type gear that connects onto a worm wheel having the output shaft of this invention secured therewith. Thus, upon a turn of the worm wheel at its desired speed, through the various speed reductions as obtained, the shaft will rotate at that speed desired for the pivoting of the barrier or warning member which connects onto said shaft at both of its ends that extend out of the support housing.

Further functioning to control the operations of this safety mechanism include cam members mounted onto one side of the projecting speed reducer shaft, and which cam members are adjustable so as to provide an adjustment in the degree of pivot attained for the said warning member between its desired upright position, and to that location where it extends directly horizontally across the roadway. The camming surfaces upon these cam members can be regulated, through adjustment, to obtain this end. A limit switch having a roller connected thereon is disposed for having its said roller arranged for riding upon the aforesaid cam surfaces, in order to provide means for detecting, when the warning member has reached the limits of its desired pivot, so that electrical controls accompanying this mechanism may be either energized, or deenergized when a particular disposition for the warning member is obtained.

In addition to the foregoing, the entire safety mechanism, including its warning member, its support housing, the motor, brake, and speed reducer, are all pivotally mounted upon a support sleeve, and which sleeve is disposed for some turning with respect to the column supported by the base of this invention. Thus, when the barrier member may be encountered by a vehicle, and pushed to some degree to the side, the entire housing, and its various aforesaid components, are free to turn or pivot with the movement of the said warning member, in order to prevent their destruction. But, in addition to the foregoing, the top of the base column includes means for providing a self centering of the warning member, and its various associated components, directly in a position across the roadway, after that force causing its turn has been removed, so that the mechanism will always be ready for immediate usage, once again, after having been turned to the side by some unauthorized vehicle or person. This self centering mechanism includes the locating of a double bevel formed upon the top of the said column, providing the appearance of a diametrically disposed V-shape across the top of said column, with the support sleeve having a shaft mounted roller, a pair of rollers being preferred, arranged for riding upon the upper circumferential bevelled edge of the said column. Thus, there is a tendency for the support sleeve, and its rollers, to always ride downwardly into the formed V provided at the top of the said base column, and when this position is achieved, the barrier, at that location, will extend directly horizontally across the roadway. But, in addition to the foregoing, when the warning member may be pushed to the side, as when struck by a vehicle, it is also desirable that the various electrical controls that normally furnish operations to this safety mechanism be temporarily deenergized. To achieve this, a microswitch is mounted upon the said support sleeve, and locates its plunger associated switch through said sleeve, for seating of its inwardmost end or point within a detent or slot formed in the surface of the base column. Thus, when some turn is encountered by the said support sleeve, through a force being exerted upon its barrier arm, the relative degree of turning or displacement encountered between the support sleeve and its base column will cause an unseating of the said plunger, thereby triggering the microswitch to effect a deenergization of the various electro-controls and components associated with the electronic operations of this device.

The electronic or electrical controls associated with this safety mechanism include the use of at least three electrical loop detectors located within the roadway surface, with two of said detectors being utilized for gauging the direction of movement of a vehicle upon the roadway, while the third detector provides means for either initiating, or not, the operations of the warning member into its operative disposition across the roadway. The preferred detector of this invention includes a form of induction coil type of detector which can increase in its generated henries when a vehicle passes upon the roadway over a particular detector. In addition, and when a detector indicates the presence of a vehicle thereon, switch means operatively associated with each detector are then initiated into closure, and when this occurs, the various other electro-components of this invention then become active for performing a particular function within the series of operations that can be entertained and performed by this safety mechanism.

Within the electrical controls of this invention, there are included two relays that are interconnected together by electrical wiring, with the relays being used to determine the direction of traffic flow upon the access ramp, with one relay, which has been identified as the time operative electrical means, is useful for providing for an immediate operation of a second relay, which is identified as the electrical controller means of this invention. The second relay, when closed, initiates the energization of the electrical motor, thereby functioning to cause its turning of the warning member into its cautionary disposition across the roadway. But, when a vehicle traveling in the proper direction crosses over the detection means within the roadway, the said first relay is closed, and since operation of the second relay depends on wiring through normally closed contacts of first relay, operation of the second relay is impossible when the first relay is energized, thereby preventing the electrical motor from being energized. A third relay coupled within the electrical system, which when energized, after a time delayed period, functions to initiate the opening of a motor control relay, thereby causing a reenergization of the electrical motor, in its reverse direction, for achieving the pivotal upward and into its nonoperative position of the warning member of this invention.

Thus, within the structure of this invention, electrical control means are provided for regulating the precise moments for operation of the warning member of this invention, In addition, the various limit switches and microswitches previously analyzed are also coupled into the electrical system of this invention, so that, as for example, when the limit switch operatively associated with the cam members mounted upon the speed reducer shaft of this invention is triggered as by reaching particular edges of the camming surfaces of the dual pair of cams, the controller relay will be opened, and remain so, thereby signaling the electrical motor to cease any further operations either in lowering of the warning member, or raising the same, since the said warning member has reached the predetermined limits of its pivotal movements. Furthermore, the microswitch associated with the column and support sleeve of this invention, as previously analyzed, is also located within the circuitry of this invention, and when closed, as through a turning of a sleeve upon its said column, the electrical circuitry of the invention is initiated open, thereby preventing any further electrical operations of the safety mechanism, and more specifically of its motor controlled pivotally disposed warning member.

DESCRIPTION OF THE PREFERRED EMBODIMENT

Figure 1:
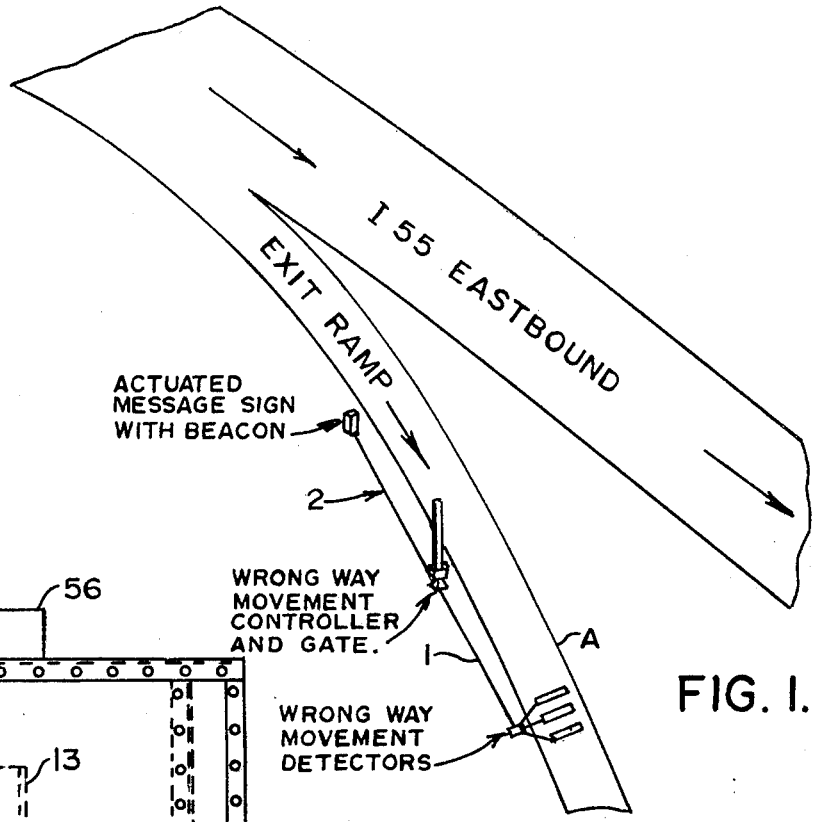
FIG. 1 discloses a schematic view of a highway and its exit ramp, showing the protection means, the warning member means, and the signaling means all operatively associated with the safety mechanism of this invention, being located adjacent to the roadway of said exit ramp.

In referring to the drawings, and in particular FIG. 1, there is shown the installation of this invention along the highway exit ramp of an interstate or other major highway, the object and purpose of this invention being to provide safety to prevent the wrong way movement of traffic upon said exit ramp, for the reasons as previously described. As shown, the exit ramp A has located just adjacent to it, and parallel therewith, the wrong way movement controller and gate of this invention, which is coupled, by way of circuit line 1, with the wrong way movement detectors, of the type that are embedded within the surface of the roadway, but which are subject to their actuation by way of electronic induction which occurs upon the movement of the vehicle thereover. Connecting by way of circuit line 2 and extending in the opposite direction from the controller and gate is any form of actuated message sign with beacon, or the like, or which may effect the ringing of a bell, or other warning means, so as to alert traffic moving in any direction that something is amiss, and that there is a vehicle approaching in the wrong direction upon the exit ramp. Furthermore, but an occurrence which is highly unlikely, just in the event that a vehicle, moving in the wrong direction, may have bypassed the barrier, an occurrence which is highly unlikely, such actuated beacons, or the like, can yet provide a final warning to that driver that something is wrong on the ramp, and that he had better stop or slow down, and display the highest degree of caution. The warning member can also have cautioning lights upon it, on both sides, to warn drivers in both directions. In addition, a camera may be positioned for filming the wrong way vehicle.

Figure 2:
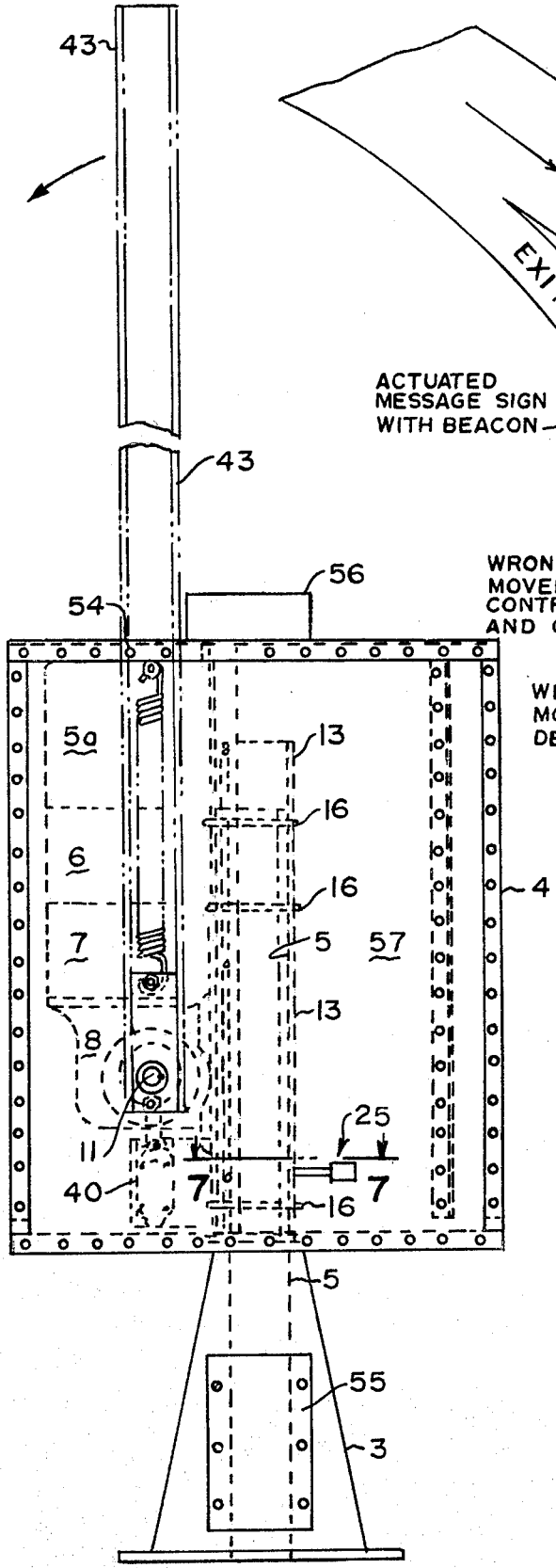
FIG. 2 provides a side view of the warning member and its support housing of this invention.
Figure 3:
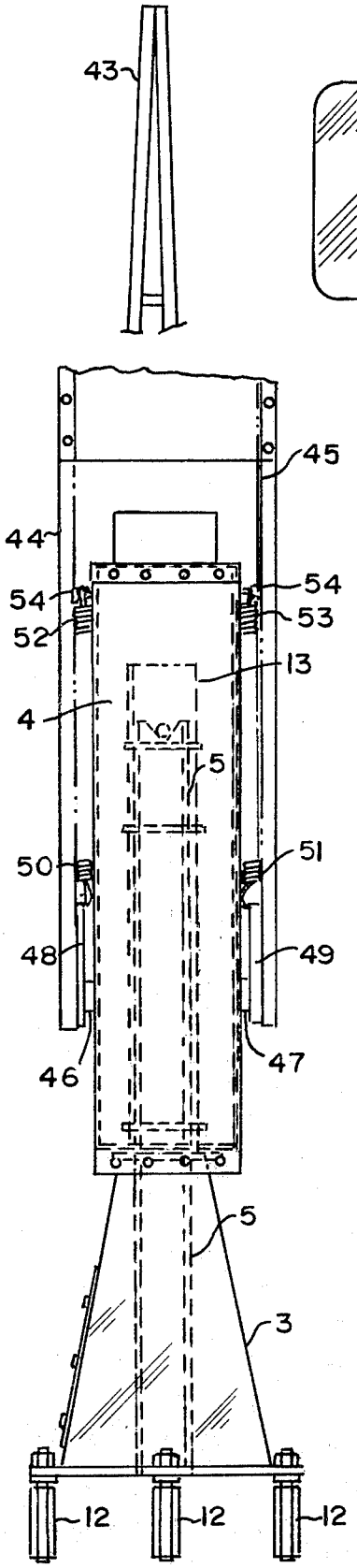
FIG. 3 provides a front view of the members shown in FIG. 2.

The particular controller and gate of this invention is more accurately shown in FIGS. 2 and 3, and as therein can be seen, it comprises a base assembly 3 which is mounted upon a concrete or other pad arranged therebelow, at a location approximately three feet, more or less, adjacent to the access roadway. This base assembly 3 which is mounted upon a concrete or other pad arranged therebelow, at a location approximately three feet, more or less, adjacent to the access roadway. This base assembly has mounted upon it a housing 4 which supports and encloses the various mechanically operative components that function to lower or raise the warning member, semaphore, or barrier arm 43 at a horizontal position across the roadway, as when located in warning condition, or erected vertically, as when maintained in its preset condition readily available for being pivoted in the event that a driver is detected moving in the wrong direction upon the exit ramp.

Associated with the base assembly is a vertical column 5, which extends downwardly into the earth, beneath the support pad, and which column carries the various electrical conduits and wires that lead from the power supply, and the various other detectors and beacon means as previously described. This column extends upwardly into the housing 4, as can be seen, carrying the various wiring, and which are essentially connected into the mechanical power means operatively associated with this device. Such means include an electrical motor 5*a* which may comprise a reversible motor being in the category of a one-half horse power, 120 volts operative motor, but obviously motors of other parameters and sizes may be utilized just as effectively within this invention. In addition, perhaps even hydraulic means, or any other type of power means that may impart force for movement of the barrier arm may be utilized within this invention. But, in its preferred embodiment, the reversing motor of this size is connected with a magnetic brake 6, which is useful within this embodiment to provide for instantaneous braking in the movement of the warning member, particularly as it moves at high speed from its nonoperative vertically disposed position, as pivoted into its horizontal barrier providing position directed laterally across the access road. The necessity for this arrangement is that this barrier arm must move at high speed into its warning position, directed laterally and horizontally across the access road, because the oncoming wrong way driver may be traveling at reasonably high speed, and if the barrier is not instantaneously located, it may be either too late in achieving this warning condition, which means the driver may have already bypassed the same, or it may achieve its warning position at a time when the driver is approaching too closely to that location where the barrier may be located, meaning that in every instance the driver may strike and break the barrier as it positions. Thus, the expense associated with having to replace the barrier arm every time it operates can become excessive, and therefore, by having the barrier arm immediately locate instantaneously across the exit ramp, before the wrong way driver ever reaches its proximity, will provide adequate time for the driver to slow down and stop, having received full caution that he is most likely traveling in the wrong direction upon that ramp.

The magnetic or other brake 6 is coupled with a speed reducer 7, in this particular instance being a five to one reducer, although other reductions may be desirable, with this speed reducer itself being coupled with a right angle drive speed reducer 8 as shown. By way of information, it might be commented that in the experimental model of this invention, the motor 5*a*, the magnetic brake 6, and the speed reducer 8 have all been acquired from the W. W. Grainger Company, of Chicago, Ill., while suppliers or other manufacturers of this type of equipment are conveniently located for suitable acquisition of these type of mechanical power means. The five to one speed reducer, in the experimental model, has been obtained from the Boston Gear Company, located in Quincy, Mass.

Figure 4:
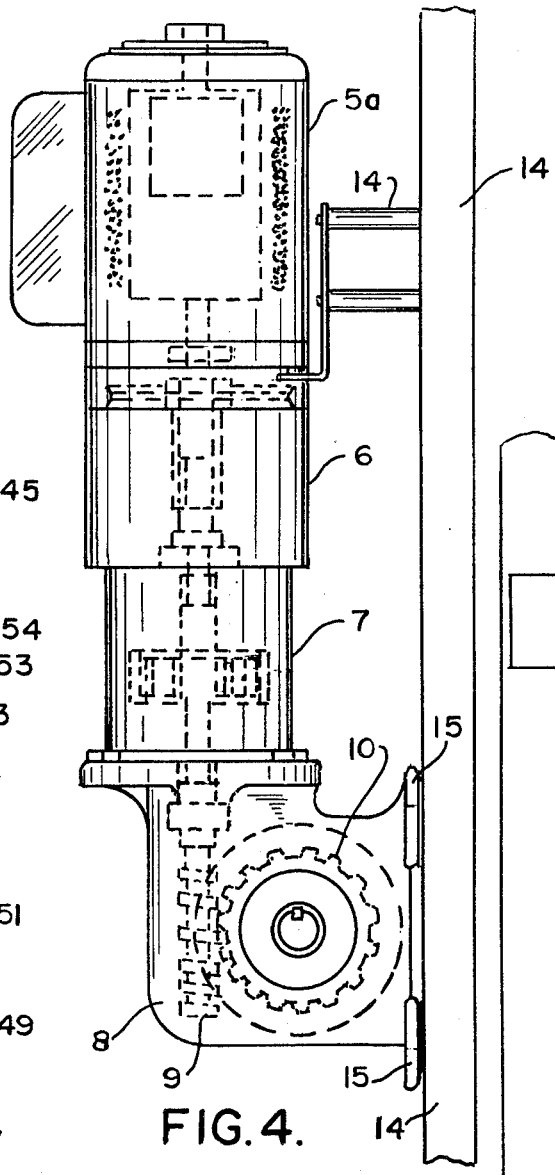
FIG. 4 furnishes a side view of the motor, brake, and speed reducer as mounted within the support housing of this invention.
Figure 5:
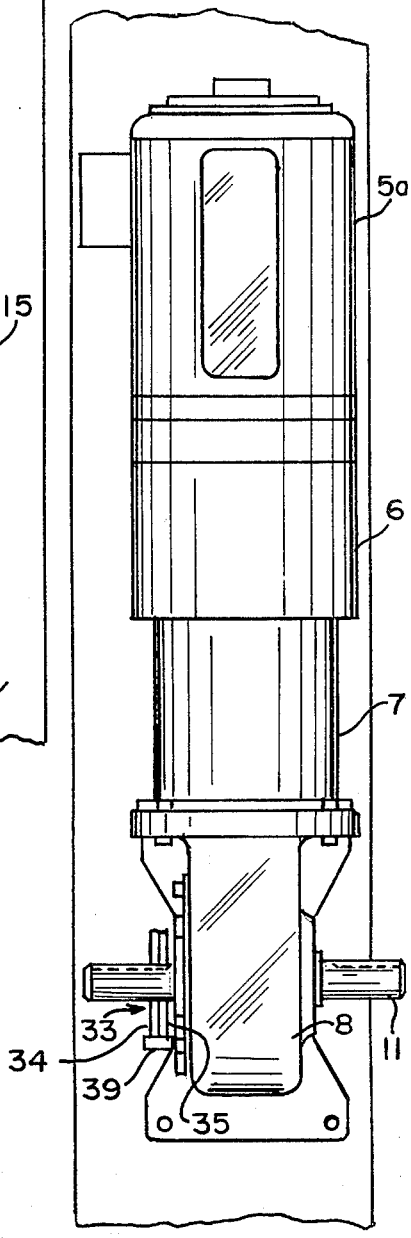
FIG. 5 furnishes a back side view of the foregoing components as identified in FIG. 4.
Figure 6:
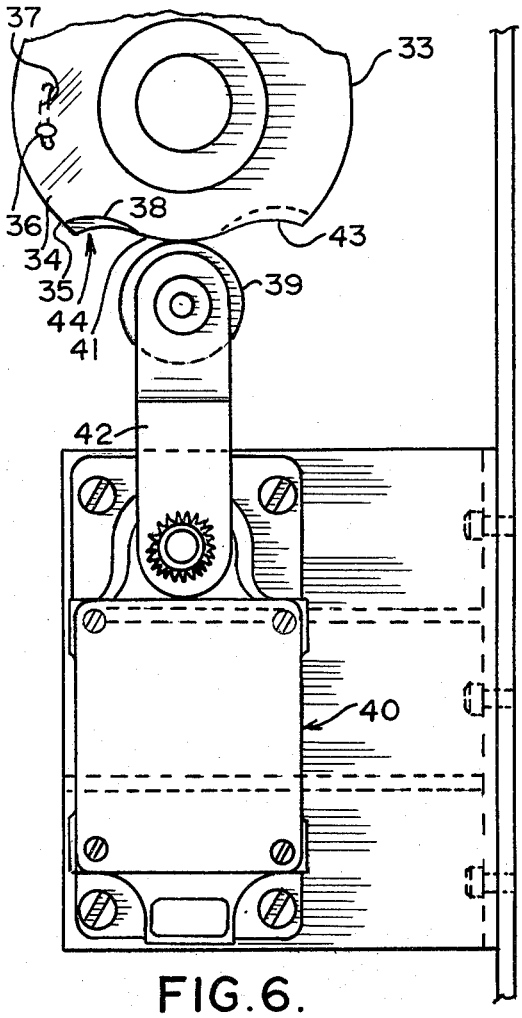
FIG. 6 discloses the cam members that mount onto the speed reducer output shaft of this safety mechanism, and having the limit switch associated with the same.

As can be seen in FIGS. 4 and 5, the physical coupling of the motor 5*a*, the magnetic brake 6, the speed reducer 7, and the right angle drive 8 are more accurately shown. The interconnection between the motor, brake, and speed reducer are of standard coupling as can be seen, while the right angle drive speed reducer 8 includes a worm gear 9 that turns a worm wheel 10, which has couple to it a double-ended cross shaft 11.

As previously explained, the column 5 extends upwardly within the housing 4, with the column further extending downwardly through the base assembly 3, as explained. The base assembly 3 is secured by means of breakaway support couplings 12 to the mounting pad of the assembly. Where the column 5 extends into the housing 4, it has mounted over it, by means of telescopic assembly, a support sleeve 13, which essentially pivotally carries all of the components located therewith, including the housing 4 itself, for reasons to be hereinafter described. It must be recognized that should any vehicle hit the barrier arm as it is extended horizontally across the roadway, means must be provided for furnishing some give to the housing and its assembly, and this is achieved by pivotally mounting all of these components upon the sleeve 13, as identified. These also include the motor, brake, and speed reducer, as previously explained. And, as can be seen in FIG. 4, a supplemental upward connector 14, and which also functions to dampen the vibrations generated from the operation of the motor, interconnects between the motor and its magnetic brake effectively with the support sleeve 13. In addition, and the main structural support comes from the coupling of the right hand drive speed reducer 8 with a support channel 14, and this is achieved by the integral flanges 15 that secure with said channel. This channel 14, in turn, is secured by means of a series of U-bolts 16 with the outer surface of the support sleeve 13, as is more accurately shown in FIG. 2. Thus, the entire assembly of the housing 4, the motor, brake, and speed reducer, in addition to the barrier arm, are all mounted rigidly with the sleeve 13, via their connection through the channel 14, and in the manner, as will be subsequently explained, the sleeve 13 is pivotally secured upon the base column 5, so that in the event any vehicle, traveling in the wrong direction, or otherwise, encounters the barrier arm, it may force their slight pivot to these components upon said column 5 in order to prevent a breakage in place, and more specifically of its barrier arm.

Figure 7:
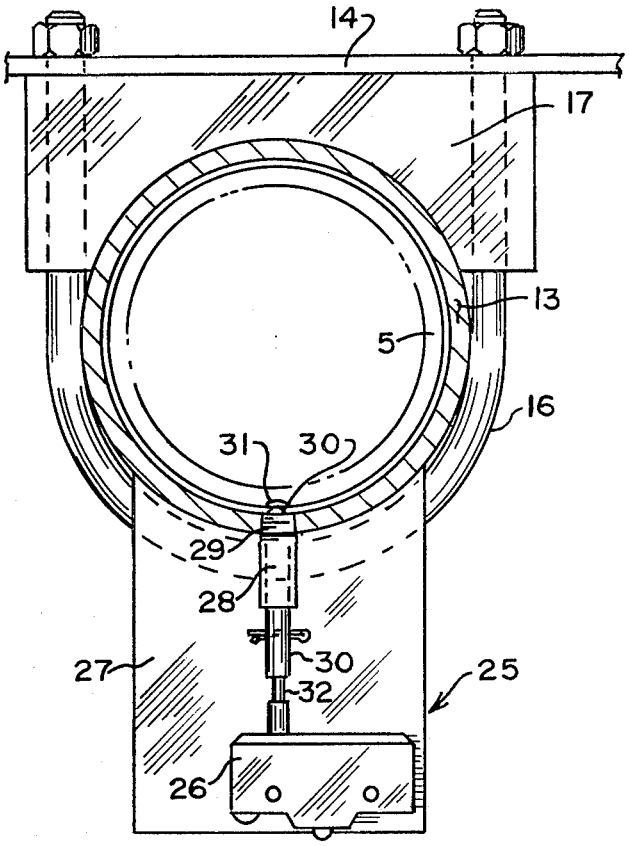
FIG. 7 discloses a sectional view taken along the line 7—7 of FIG. 2, showing the microswitch associated between the support sleeve and the column for detecting when the warning member has been forcefully turned to the side.
Figure 8:
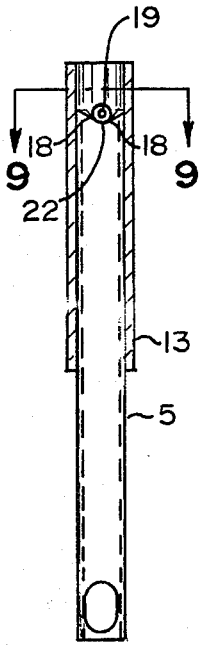
FIG. 8 provides a side view of the column having the support sleeve roller mounted thereupon and functioning as the self-centering device of this invention.
Figure 9:
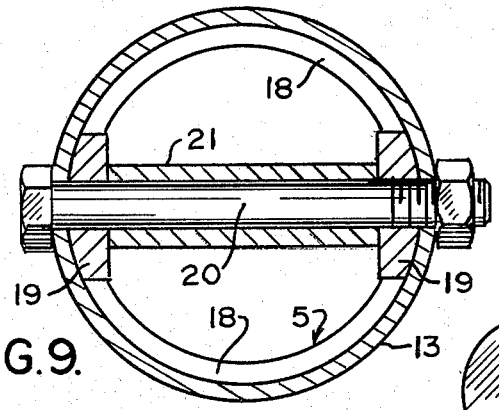
FIG. 9 discloses a sectional view of the said support sleeve and column taken along the line 9—9 of FIG. 8.

The connection of the support channel 14 by means of the U-bolts 16 to the outer surface of the sleeve 13 is more accurately shown in FIG. 7. As can be seen, a semi-circular clamp and bracket 17 provides intermediate structural rigidity between the channel 14, and the sleeve 13.

Figure 11:
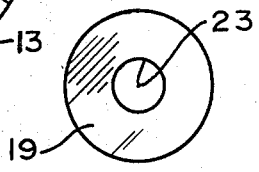
FIG. 11 provides a side view of the roller displayed in FIG. 10.
Figure 10:
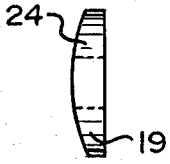
FIG. 10 furnishes a side view of one of the rollers operatively associated with the support sleeve of this invention as shown in FIG. 9.

While the sleeve 13, and its various supported components, are capable of pivoting upon the column 5, as previously explained, it is desirable, though, to provide means for constantly urging the barrier to its aligned location across the exit ramp, as for disposition in its operative position, and this is achieved through the usage of a self centering type of support arranged between said sleeve 13, and the column 5. In referring to FIGS. 8 through 11, it can be seen that the column 5, at its upper end, is cut upon a V shaped bevel 18, which extend diametrically across the upper edge of said column 5, and located for riding within said arranged bevel are a pair of rollers 19, which are mounted for rotating with respect to the sleeve 13 by means of the shaft or bolt 20. In order to assure that the rollers 19 are permanently spaced apart, as can be seen, a spacer tube 21 is located therebetween, and thereby arrange the said rollers in a position just interiorly contiguous of the sleeve 13, as shown. And, and as can be further seen, these rollers are arranged for riding upon the upper beveled edges 18 of the said column 5. Thus, the rollers of the sleeve 13 have a tendency to always ride downwardly into the lowest position of the said bevels as formed along the upper edge of the said column 5, and gravity attraction assures that the rollers will always seek a settled seating at this location upon said column 5. As can also be seen in FIGS. 10 and 11, these rollers, obviously, are circular in shape, having the aperture 23 disposed therethrough, so as to accommodate the insertion of the shaft 20 therethrough. In addition, the outer surface 24 of each roller, as shown, is formed convex in configuration, so as to conform with the internal curvature of the sleeve 13, and be capable of rotation in proximity therewith, but yet without encountering any significant friction such as will prevent their free rotation upon the upper bevelled edge of the column 5, and their attraction by way of gravity for rolling into the lowest point 22 of the same. When these rollers 19 and their associated sleeve 13 are seated within and at the location of the seat 22, of the column 5, the barrier will be located precisely across the highway access ramp, or be arranged in a vertical location such that when it is triggered, it will attain such horizontal positioning across the access ramp, and will remain in that position unless a vehicle physically encounters the located barrier and causes its slight pivot due to such an impact.

As can be seen in FIGS. 2 and 7, a switch means 25, and which comprises a micro or other switch 26, is mounted upon a suitable bracket 27 stably with the outer surface of the sleeve 13. A sleeve support 28 is threaded through the surface of the said sleeve 13, by means of its threads 29, and carries a plunger 30 which is slide mounted therein, and which plunger seats within a detent 31 provided within the surface of the column 5. This plunger 30 extends rearwardly and is in contact with or coupled to the microswitch plunger 32. Thus, when the sleeve 13 pivots upon the column 5, in a manner as just previously described, the plunger 30 will unseat from within the detent 31, of the column 5, thereby causing the microswitch 26 to become actuated. The purpose for this actuation will be subsequently analyzed when describing the circuit diagram, and its operations, for this invention. The object, though, for this microswitch is to provide a signal to the circuitry of this device that the barrier has been hit, and that it should not be automatically raised or retracted, as usually occurs after a predetermined period of time, mainly because the barrier may be hooked onto the grill of the vehicle, or located under a truck, and therefore, it will only surely be broken in the event that there is an attempt to raise the same, or some damage may be caused to the gearing mechanism of this invention, in the event that maneuver is attempted.

Referring once again to the FIGS. 2, 4, 5, and 6, the double-ended shaft 11 has mounted upon it, on one side, an adjustable cam 33. This adjustable cam 33 comprises actually a pair of cams 34 and 35, which are pinned together by means of a bolt 36, with one of the cams having an arcuate slot 37 provided therethrough. These cams are identical in their cam surface contour, but that they can be adjusted relative to each other by means of a loosening of the fastener 36, and then pivoted, one of the cams relative to the other, so that their camming surface may become unaligned therewith. For example, the cam 35 has its camming surface 38 adjusted for engagement with the cam roller 39, of the limit switch 40, while the cam 34 has its camming surface 41 likewise adjusted for being contacted by the said cam roller 39. But, as can be seen, since the camming surfaces 38 and 41 are now out of alignment, it can be seen that the dimension for operations of the limit switch has been reduced, since the combined width of the cam operative surfaces has likewise been reduced due to the relative pivot of these two cams with respect to each other, thereby limiting the width of the surface over which the roller 39 can move before its actuation. Thus, as will be subsequently described, through the adjustment of these two cams 34 and 35 relative to each other, you can adjust the travel of the barrier arm for the gate, between its perpendicular nonoperative position, to the horizontal operative position across the highway. Thus, the maximum dimension of pivot of the barrier is obtained when the two cams surfaces are in alignment with each other, but that the angle of pivot can be reduced to a maximum degree when the two said cams 34 and 35, and more specifically their cams surfaces 38 and 41, are arranged further from alignment. Thus, by the adjustment of these cams, depending upon the terrain where the barrier is located adjacent to a highway exit ramp, they can be adjusted so that the barrier arm will be disposed substantially vertically when inoperative, or arranged horizontally across the access ramp. This angle may be at a 90° angle, or more or less than that, to some degree, but the uniqueness of this invention, through the relationship of this cam mechanism, is to allow the barrier arm to be adjusted, even on situs, after installation, so that it will undertake the particular angular relationship required to provide for the most effective operations of this carrier mechanism after its installation. The limit switch 40, as can be seen, as in FIG. 2, is stably mounted within the housing 4, and extends its pivot link 42 upwardly for mounting of the cam roller 39. This is a pivot type of limit switch, where its link will pivot a few degrees from one side to the other depending upon which cam surface is being encountered. For example, as the barrier arm is pivoted into a horizontal position across the roadway, the adjusted cam edge at 43 will encounter the roller 39, push its link 42 a few degrees to the side, where it remains, and instructs the circuitry of this device to immediately curtail any further operations of the motor 5, since the barrier arm has now reached its desirable horizontal location across the ramp. The link 42 will remain in that position, until such time as other circuitry instructs the motor to operate in reverse, to raise the barrier arm, at which time, this operation occurs until the cam surface located approximately at 44 moves the cam roller 39 to pivot slightly in the opposite direction, to thereby reactuate the limit switch 40 and instruct the motor, once again, to stop, since the barrier arm has now reached its vertically desired nonoperative position. The details of this operation, from an electrical standpoint, will be subsequently analyzed. In any event, this type of limit switch may be acquired from National Acme Corporation, of Cleveland, Ohio, and it generally is of a double throw type of pivotal toggle switch that is capable of maintaining or remaining in the position to which it has been triggered, and stay there until an external force causes its pivot to an opposite or other position.

As can be seen in FIGS. 2 and 3, the barrier arm 43 is actually designed having a pair of arms 44 and 45, and which straddle the housing 4 to either side, and which are mounted upon the exposed ends of the double-ended shaft 11, through suitable hubs 46 and 47. And, it may be commented that one of the hubs also is useful for mounting the pair of cams 34 and 35, which afford the angular control for movement of the said barrier arm 43. Also connecting with the hubs 46 and 47 are a pair of hub arms 48 and 49, respectively, and these hubarms are disposed for having mounted to them the barrier or semaphore arms 44 and 45. Suitable fasteners, such as bolts, are useful for securing these arm members together. Securing with the upper end, or that end of the hub arms 46 and 47 arranged opposite from their securement upon the said hubs, are springs 50 and 51, respectively, with the upper ends of 52 and 53 of said springs being pinned to the approximate upper edge of the housing 4. This pinned arrangement is shown at 54. When the barrier arm 43 is arranged erect, or vertically, it can be seen that the springs 50 and 51 are aligned therewith, and exert little or no bias upon said arm. But, when the barrier arm 43, or more specifically its arm portions 44 and 45, are pivoted downwardly, as in the counterclockwise direction, horizontally across the highway, it can be seen that the lower ends 50 and 51 of the springs are likewise pulled by means of the hub arms 48 and 49, being tensioned due to their stretching, and which exert a constant bias upon the said now horizontally disposed warning member 43. This forms a sort of torque bias upon the arm, which counteracts against its weight, and facilitates the more easier braking of the assembly, thereby reducing the magnitude of the magnetic brake 6 required to stop the arm as it is being located across the access roadway. In addition, when the arm is moved upwardly into its vertical nonoperative position, the bias of these springs aid in the elevation of said arm, thereby reducing the load requirements upon the motor and speed reducers operating to achieve such.

Various other and incidental components associated with this invention include an access cover 55 provided upon the base assembly 3, which upon its removal authorizes access to the wiring of this mechanism. In addition, the external power controller box 56 is provided upon the upper surface of the housing 4, and which when opened, allows the maintenance man to obtain access to a switch which may be used for turning on of the system, or in the alternative, turning it off, as when the device may require maintenance, as after it has been deactivated and damaged as when a vehicle may have hit the barrier arm 43. But, this box may be locked in order to prevent unauthorized access to the same. In addition, sufficient clearance is provided in the back side of the housing 4, as at the location at 57, to provide space for locating of the various electrical operative components that are required for obtaining controlled operations for this invention. Furthermore, and as previously analyzed, the various motor and brake mechanisms, and the speed reducers, are located at the frontal portion of the housing, and from which the barrier arm 43 of this invention may pivot between its vertical and horizontal dispositions.

Figure 12:
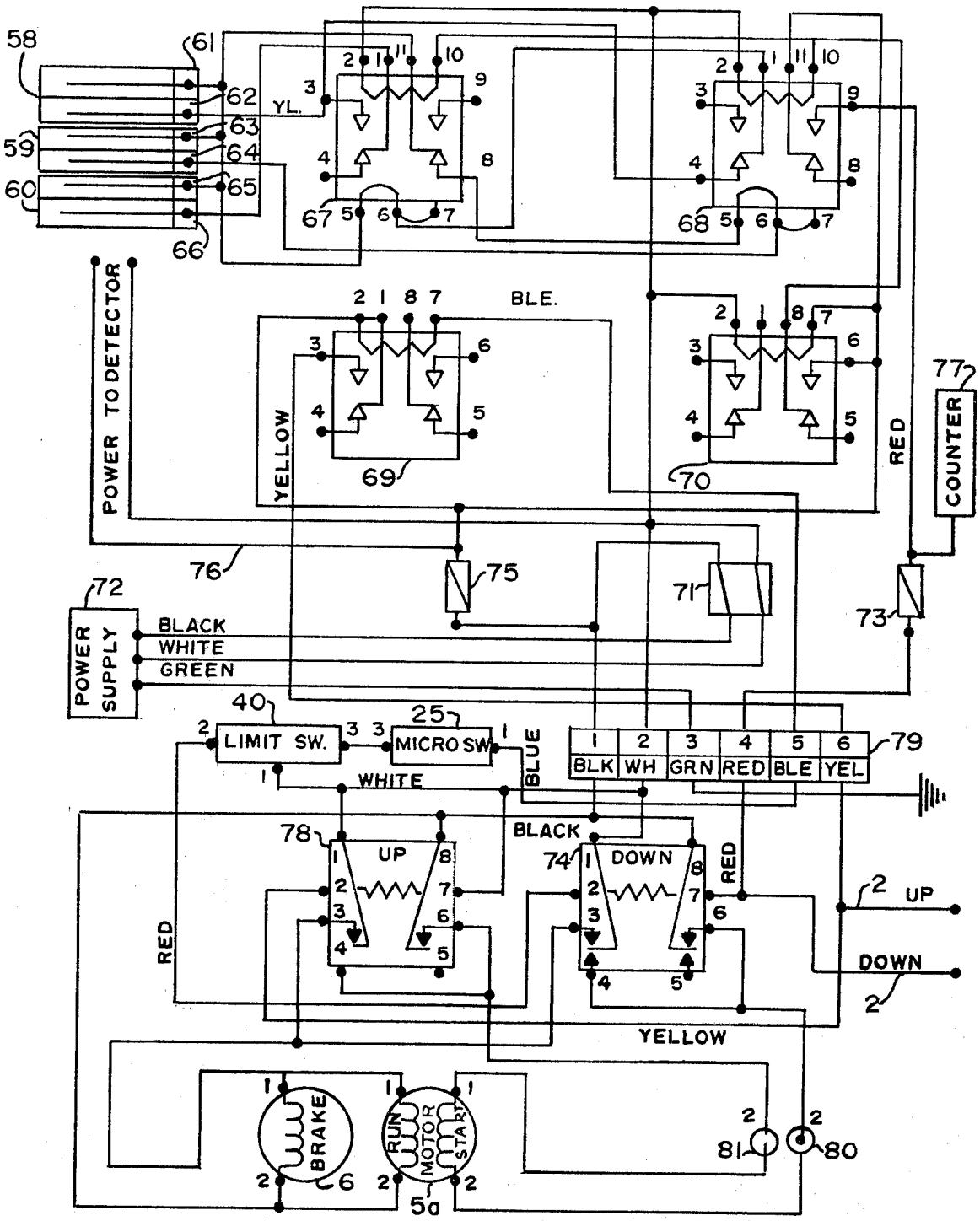
FIG. 12 furnishes an electrical schematic view of the various electrical components utilized and electrically controlling the operations of this safety mechanism.

The electronic controls for providing for operation of this invention are shown in FIG. 12. As can be seen, the wrong way movement detectors, as previously depicted in FIG. 1, may comprise three roadway loop detector units 58, 59, and 60 that are arranged within the roadway, and capable of having traffic conveniently pass thereover, but when it does occur, these units are capable of detecting the presence of a vehicle, and during such presence, operate to also detect the direction of movement of the vehicle, by closing, in various sequences their associated normally opened switches, said switches when urged into closure, are capable of pulsing a signal, due to the presence of the vehicle upon said units. More specifically, these roadway detection units 58 through 60 are available from many sources, but in the experiemental model of this invention, said units have been acquired from Canoga Controls Corporation, of Canoga Park, Calif., and comprise their model No. 404. Just by way of example, the switches associated with each unit are located in this schematic, at 61 through 66. Electrically connected with these switches 61 through 66 are a series of three relays, as identified at 67, 68, and 69. Two of these relays 67 and 68 are interconnected together by electrical wiring, as can be seen, but the wiring is connected to the various externally located relay pins, as shown. The objects and purposes for these two relays are to determine the direction of traffic flow upon the access ramp, and to initiate, or not, the operations of the warning member, with the relay 67 being a component useful as a part of the sensory circuit, functioning as a time operative electrical means, and which in conjunction with the relay 68, or controller means, may affect or cause the gate to be lowered upon sensing of a vehicle traveling in the wrong direction. And, the relay 69 functions to automatically retract or elevate the roadway barrier after a select and predetermined period of time, provided that the roadway barrier has not been deflected or broken as upon its being hit or struck by a vehicle. The relay number 70 prevents power application to the various relays 67 through 69, until such time as the detector circuits associated with the units 58 through 60 have normalized as after a power interruption, caused at or by the power company, or at least remote from this safety mechanism. For example, should there be some minor or slight interruption in the power supply, which may occur from the power plant, or elsewhere, the object of the relay 70 is to prevent the untimely actuation of the barrier in the event that some type of electrical disruption may occur, even though no vehicle has passed over the detector units 58 through 60. Thus, it is designed to prevent a false start in the operations of this highway barrier.

A main switch 71 is provided within the circuit line leading from the power supply 72. There is provided a gate switch 73 which is useful for opening of the relay 68, which, due to its actuation, may have been closed, but that it may not be desired to lower the gate at such time, so that the switch 73 prevents the conduct of a charge or signal to the down barrier relay 74, which then prevents the barrier arm from pivoting into its horizontal and operative position across the roadway. This switch 73 generally will be actuated by the maintenance man who may be servicing the invention, and wants to determine whether its relay 68 is properly functioning, but at the same time, does not want the gate lowered. The switch 75 is provided within the circuitry, and once again, is manually operative, as by the service man, so as to authorize a cut-off of all electrical charge to the various relays 67 through 70 in addition to cutting off power through the circuit line 76 to the detector units 58 through 60. Thus, the foregoing describes components, with the exception of the relay 74, that or principally associated with the detection circuitry, and which can be manually regulated as through manipulation of the switches 71, 73, and 75, so as to cut off their functioning particularly during servicing.

The counter 77 is useful for noting and recording the number of times that the warning member has closed, and which provides a fairly accurate representation as to the number of vehicles that have been detected traveling in the wrong direction.

It may also be stated that all the circuit lines identified by the color code are common lines for each color set forth.

The various electrical components associated with the power operation of the motor 5*a*, brake 6 and their associated speed reducers, are depicted in the lower portion of this FIG. 12. These components include, as previously explained, the gate down relay 74, while at the same time, a gate up relay 78 is also provided within this circuitry. The microswitch 25, as previously explained, is likewise operatively associated with this portion of the circuitry, while the limit switch 40 is also provided within the circuitry. In addition, connected through the circuitry are the circuit lines 2, which provide power for actuation of the message sign or other beacon, as previously explained in FIG. 1, and this particularly is energized when the down relay is energized into function, for lowering the warning member into its horizontal position across the roadway.

A six way plug 79 is provided to furnish a quick connection between the detection circuitry, as previously explained, provided in the upward half of this figure, with the power circuitry arranged therebelow. The motor 5*a* is connected into this circuitry, as shown, as is its associated magnetic brake 6. There are a pair of reverse plugs 80 and 81 provided within the circuit line leading towards the start wiring of the electrical motor 5*a*, so that when the motor is installed within the device, and turned on, the operations of this reversing motor can be properly corrected through these plugs to provide for the correct initial rotation of the barrier arm upon start-up.

An example of the operation of this circuitry, as when a vehicle is traveling in the wrong direction upon the access road, is as follows. When a vehicle passes in the wrong direction on the highway exit ramp, as shown, it passes over the buried detector loop coils numbers 60, 59, and 58, in that sequence. These coils or detector units are connected to their respective switches 66 and 65, 64 and 63, and 62 and 61, respectively. And, these channels or switches which normally have open contacts, will be closed due to the passing of the vehicle thereover. But, this closure takes place in the sequence as previously described, due to the vehicle traveling first over the unit 60, then over the unit 59, and following this over the unit 58. When a vehicle is over the unit number 60, it closes its contacts 66 and 65, and these contacts will remain closed for ten seconds after the car has passed. In addition, when the vehicle passes over the detector unit 59, its associated contacts 64 and 63 will close momentarily, generally only for approximately one hundred milliseconds of time. When the vehicle is over the unit 60, and its associated contacts 66 and 65 are closed, a signal will be conducted through the circuit line leading from switch 66 and to the pin 1 of relay 67, and through said relay to its open circuit at pin 4. In this condition, this relay will not cause the gate to close. But, charge is conducted from the switch contact 65, into pin 5 of the relay 67, through its internal circuit to pin 6, and then on to pin number 1 of relay 68, where it passes out through its pin 4, and back to the pin 3 of relay 67, which is maintained normally open. And, as can be seen, the connection with pin 3 of relay 67 also connects with the switch contact 62, of the unit 58, but since the vehicle has not passed over that unit as yet, nothing occurs. Now, the vehicle moves over the detector unit 59, so that its detector switch contacts 64 and 63 now close. The contact 64 is connected to the pin 6 of relay 68, and conducts charge thereto, out its associated pin 5, and into pin 8 or relay 67, through its normally closed contact and to the pin 11, and to the switch contact 63 of the unit 59. When this occurs, the circuit is now complete and the relay 68 is charged for operation, and closes for approximately a five second period of time, as this relay is timed for operation. This relay 68 is a hybrid type solid state class of relay of the slow release type, which in this case, is designed to remain closed for approximately a five second period of time. This relay functions as the time operative electrical means for the circuit operations of this invention. This amount of time is considered ample to allow the electrical motor 5 to be energized and get the gate into it horizontal and operative position in pivoting it from its vertical nonoperative location. These type of relays 67 and 68 are readily available upon the market, and can be acquired from the W. W. Grainger Company of Chicago, Ill. Thus, this relay 68, being of the slow release type, is timed to release and return to normal after a five second period of time, and it is energized by an instantaneous pulse received from the detector unit 59. The reason for use of a time delay relay in this circuitry, such as relay 68, is that if a standard relay were used, and only functioned during the presence of the vehicle upon the detector unit 50, this would not provide sufficient time for lowering of the gate into its barrier positioning. During this period of time, the relay 68 operates its normally open contact pins 9 and 11 to close, and when this occurs, the power supplied to its pin 11 is now available for transmission through the pin 9, which is supplied to the pin 7 of the down relay 74. This charge passes through the previously described switch 73, which under standard and routine operations of the barrier, will remain closed. The charge flows through the operating coil from the pin 7 to the pin 2 of the down relay 74, and passes on through the limit switch 40, as shown. At this time the semaphore arm is in its erect position, and the limit switch contacts 1 and 2 are normally closed. This permits the power to flow through the limit switch 40, and on to the pin number 1 of the down relay 74. Thus, the limit switch 40 as normally being closed is within the circuitry of the power derived from the common white circuit line of the power supply, which also connects through the plug 79 to the pin number 1 of the down relay 74. At the same time, power from the common black circuit line is conducted to the pin 8 of the down relay 74. Since this relay has now been energized or closed, power from its pin 8 is conducted to its pin 6 of the down relay 74. Since this relay has now been energized or closed, power from its pin 8 is conducted to its pin 6, which are now in contact, of this normally opened relay, and power from pin 6 is conducted through the jumper line to the pin 4 and on to the pin number 2 of the motor start windings. At the same time, the current to the white circuit line is available at the pin 1 of the down relay 74, and which now passes through to its now closed contact 3 and onto the contact 3 of the up relay 78, and out of the normally closed contact 4, and on through the circuit line to the pin 1 of the motor start windings. This starts the energization of the motor, and in the event that the motor turns in a direction opposite that desired, then the reversing plugs 80 and 81 can be interchanged. Also, at this time, current is available at the pin 3 of the down relay 74, which are now closed, as previously described, and the charge is now supplied to the pins 1 of both the magnetic brake 6 and the run windings of the motor 5. Charge is then conducted out of the pin 2 of both the brake and said motor, and in conducted to the pin 8 of both the up relay 78 and the down relay 74. Both of these pins are constantly charged under routine operations of this device.

Now the down relay will remain closed for five seconds, due to the operations of the relay 68, which is the amount of time required for the motor to drive the semaphore arm downwardly, only to be stopped when the limit switch 40 is tripped, as when the semaphore reaches its horizontal position. Simultaneously, the down relay causes the motor brake to be released, and also the motor start winding to be connected so as to cause the motor to run in such a direction to lower the semaphore and also to cause the power to flow to the motor run windings.

If the gate has not been struck, the normally closed microswitch contacts 1 and 3, of the microswitch 25, will remain closed. The white wire of the power neutral is passed through the limit switch at its terminal 1, out through its terminal 3, to be connected to the microswitch contact 3 and out through the microswitch contact 1, through its blue wire to the relay 69, through its pin 7, and through the operating coil and out its pin 2 of said relay (pins 1 and 2 being connected by an external jumper) and from the said pin 2 of the said relay 69 to the closed power supply switch 75, which is connected to the black wire of the power supply. Now, the relay 69, which also functions as are electrical controller means, will operate for a predetermined period of time, gauged anywhere between twenty seconds to twenty minutes, according to the timer setting contained within said relay 69, and after an elapse of such time, the relay operates to pass current through the normally open contact pin 1, out its pin 3, since the relay is now closed, and through the yellow wire to the motor gate up relay 78 pin 2, and through its operating coil and out of its pin 7 to the white neutral wire. This provides a delay in the raising of the gate, or the interruption needed in the event the gate has been hit. Thus, charge is provided through the microswitch 25, in this manner, to accomplish such.

While the foregoing is occurring, the circuit is now complete and the up relay coil is energized. Now charge flows from the pin 8 of the gate up relay, and out through its now closed contact with the pin 6, to the pin 1 of the motor start windings. The charge is conducted out of the pin 2 of the motor start winding and to the pin 4 of the normally closed contacts of the down relay through and out of its pin 1, and to the white neutral wire, as shown. This gets the start winding to operate and to energize the motor in a reverse direction from that at which it had previously operated. The motor start coil is now energized, and in a reverse direction. Since the motor brake and motor run winding pins 2 are always connected to the black power supply, and the neutral supply is through the up relay 78 pin 1, which is normally opened, but now closed, to the pin 3, the charge is conducted onto the motor and motor brake pins 1. Thus, when this condition prevails, the gate is now driven upwardly. Within a moment travel is stopped once again by operations of a limit switch 40 being activated when the gate attains its vertical position.

A description might be made as to the sequence of inoperation of the gate or warning member when vehicles pass routinely over the detector unit in a correct direction of traffic flow. Traffic proceeding normally along the highway exit ramp crosses over the buried detector unit 58, then over the unit 59, and then in sequence over the unit 60. Each of these units, a previously explained, are connected to their respective detector switches 61 through 66. Each of these units, as previously explained, are of sufficient length to span the width of the roadway, and they may be approximately four feet in width when installed. These units are normally spaced approximately two to four feet apart from each other, so that there is no overlap in the units sensing of traffic passing thereupon and which could disrupt their normal operations.

When the vehicle presence is detected over the unit number 58, the detection of the vehicle by said unit closes the pair of normally opened contacts 61 and 62 of this unit. The closed switch terminal 62 is connected to the relay number 68 through its pin 4, which is normally closed with its pin number 1, and conducts charge onto the pin number 6 of the relay 67, out the pin 5 of said relay to the switch contact 61 of the detector unit 58. Now the relay 67 operates because the external switch contacts 61 and 62 are closed which function as external switches for the said relay 67. The timer on the relay 67 is adjusted to function for ten seconds, which means that after traffic has passed from the influence of the unit 58, its presence will be indicated for additional ten seconds. It might be commented that when traffic was passing in the wrong direction, this relay 67 really had no function other than to pass charge through it, without actuating its time delayed mechanism, which is actuated when traffic passes in the proper direction.

The vehicle passing in the right direction now passes over the detector unit 59, causing its switch contacts 63 and 64 to close for a one hundred millisecond pulse, and therefore, the switch contact 64 is momentarily connected to the pin 6 of relay 68, out of its pin 5, and thence onto pin 8 of the relay 67. But since relay 67 is still energized, the circuit is interrupted by its normally closed pins 8 and 11, which are now open. Thus, relay 68 is rendered inoperative, and prevents the gate from closing in the manner as previously described when analyzing the flow of a vehicle in the wrong direction. Traffic now influences the detector unit 60, and its normally opened switch contacts 65 and 66, are forced into closure. But, at the same time, the terminal 62 is connected to the pin 4 of the relay 68, and through its normally closed contacts and out of the pin 1 of said relay, and to the pin 6 of relay 67, out of its pin 5, out of relay number 67, and to the switch contact 61. Therefore, the relay will continue to remain activated for ten seconds after traffic has passed from the influence of the detector unit number 60. Traffic has now successfully passed over the road loop coils in the sequence of the detector units number 58, 59, and then 60, and no warning member or semaphore action or pivot will occur, meaning that the semaphore will remain in its upright and erect position.

Various modifications or variations to the structure and operation of this invention may occur to those skilled in the art upon reviewing the subject matter of this disclosure. Such variations, if within the spirit of the invention analyzed, are intended to be encompassed by any claims to patent protection issuing hereon. The description of the preferred embodiment set forth is set forth for illustrative purposes only.

Having thus described the invention what is claimed and desired to be secured by Letters Patent is:

1. An electrically controlled safety mechanism for a highway exit ramp or other roadway and useful for alterting a driver of a vehicle as to the vehicle's incorrect direction of movement upon said ramp or other roadway and comprising, a series of electrically controlled detection means provided within the roadway and of the type capable of sensing the presence, correct, and incorrect direction of movement of a vehicle thereacross, a warning member and a support housing for said mechanism, a base means supporting said warning member and support housing laterally of the ramp or roadway, said warning member being pivotally mounted with respect to said housing and capable of being disposed in a nonoperative position and then pivoted into a horizontal position operatively across the roadway when its operations are initiated by the said electrically regulated detection means, drive means operatively associated with said housing for imparting when energized the pivotal movements to the said warning member, time operative electrical means electrically connected with said detection means, electrical controller means connected with said time operative electrical means, said electrical controller means initiating the energization of the said drive means for pivoting the warning member into its warning position when vehicle movement is detected in the incorrect direction, and said controller means prevented from initiating energization of the motor means by operation of the time operative electrical means when a vehicle is detected traveling in the correct direction.

2. The invention of claim 1 and wherein said drive means includes a motor, brake means, and speed reducer means operatively connected together to initiate and then curtail any further pivotal movement of the warning member as it reaches the limits of its movement between its upright nonoperative and horizontal warning positions.

3. The invention of claim 2 and wherein said speed reducer means includes a right hand drive speed reducer.

4. The invention of claim 2 and wherein the output of the said speed reducer includes a laterally extending shaft, said warning member being mounted to said shaft for pivotal movement therewith.

5. The invention of claim 4 and including a cam means mounted upon said shaft, said cam capable of entertaining pivotal movement with the pivotal movement of said shaft.

6. The invention of claim 5 and including a limit switch having a roller contacting said cam, said cam including contours for triggering said limit switch and determining the limits of pivotal movement of said warning member.

7. The invention of claim 6 and wherein said cam comprises a pair of contiguous cam members, each cam member having a camming contour formed thereon, said pair of cam members being adjustable with respect to each other to provide for adjustment in the moment of triggering of said limit switch at the limits of the pivatol movement of said warning member.

8. The invention of claim 2 and including a column provided with said base means, said column extending upwardly into said support housing, and said column useful for supporting said housing, the warning member, and the drive means.

9. The invention of claim 8 and including a supporting sleeve mounted upon the upper segment of said column, said sleeve capable of relative turning movement with respect to said column, said housing, warning member, and drive means being mounted upon said supporting sleeve, whereby upon a vehicle encountering the warning member when disposed in a operative position across the said ramp these mounted members turn under the force of the encountered vehicle and thereby lessen the occasion of damage to the same.

10. The invention of claim 9 and including means operatively associated between the column and supporting sleeve to effect centering of the warning member across the highway ramp after it has been encountered and moved by a vehicle.

11. This invention of claim 10 and wherein said centering means includes the upper end of said column having a downwardly formed double bevel having its lowermost point formed diametrically across said column, said support sleeve having a shaft disposed therethrough, at least one roller disposed upon said shaft for rotation thereon, said roller disposed for riding within the column formed bevel, whereby upon the release of the warning member after being moved from its alignment across the highway ramp, said centering means urges the said warning member back into alignment horizontally across the said ramp.

12. The invention of claim 11 and including switch means sensitive to the relative turning movement and displacement between the said support sleeve upon its column for detecting such movement and in response thereto curtailing the further electrical and mechanical operations of the safety mechanism while such displacement exists.

13. The invention of claim 12 and wherein said switch means includes a plunger mechanism extending through the support sleeve and projecting into for seating within the said column, the relative turning displacement between the said sleeve and column causing said plunger to unseat from the column and thereafter trigger said switch to effect an electrical and mechanical shut-off of the safety mechanism.

14. The invention of claim 1 and wherein said electrically controlled detection means comprises induction coils that are sensitive to a change in the induction created within their coils when a vehicle crosses over said detection means.

15. The invention of claim 14 and wherein said time operative electrical means comprises a time delayed operating relay.

16. The invention of claim 15 and wherein said electrical controller means comprises an electrically energizable relay.

17. The invention of claim 16 and including another relay means connected to the electrical controller means and when energized effecting a retraction and elevation of the warning member after a select predetermined period of time.

18. The invention of claims 17 and including another relay means connected within this circuitry of the safety mechanism and useful for preventing power application to the various other relays until such time as the electrically controlled detection means have normalized after electrical power interruption.

19. The invention of claims 3 or 4 and wherein said laterally extending shaft comprises the output shaft of the said right hand drive speed reducer.

20. The invention of claim 15 and including a counter means electrically connected to the controller relay and useful for counting the number of warning member pivots into operative position upon detecting vehicle movement in the wrong direction upon the roadway.

21. In the process for detecting the wrongway movement of traffic upon a highway exit ramp, and which includes an electrical control safety mechanism for detecting such vehicle movement, the process of including locating at least three electrically controlled detection means within the roadway such that when a vehicle moving in the wrong direction passes over said detection means in one direction, a first time controlled relay refrains from interfering with the actuation of a second controller relay, so that said second controller relay is energized for inducing operations of a down relay that energizes an electrical motor for locating a warning member into a horizontal and traffic impeding position across said roadway, and wheren traffic moving in the proper direction upon said roadway is likewise detected by said electrically controlled detection means so that the said time controlled relay is actuated for a ten second period of time, thereby preventing the controller relay from being actuated, and preventing the warning member from pivoting into its horizontal direction.

22. The invention of claim 21 and wherein said vehicle moving in the proper direction pasees over the detection means, the time controlled relay is doubly actuated for preventing the said controller relay from being actuated for another ten second period of time, thereby preventing the warning member from being disposed into its operative position.

23. The invention of claim 22 wherein upon operation of a down relay for disposing the warning member into its operative horizontal position across the roadway, a third time controlled relay functions after a designated period of time to actuate an up relay for inducing a return of the warning member into its vertical nonoperative position.

* * * * *